US009297525B2

(12) United States Patent
Cao

(10) Patent No.: US 9,297,525 B2
(45) Date of Patent: Mar. 29, 2016

(54) PIXILATED LED LIGHT SOURCE FOR CHANNEL LETTER ILLUMINATION

(75) Inventor: Densen Cao, Sandy, UT (US)

(73) Assignee: EPISTAR CORPORATION, Hsinchu (TW)

( * ) Notice: Subject to any disclaimer, the term of this patent is extended or adjusted under 35 U.S.C. 154(b) by 0 days.

(21) Appl. No.: 12/687,838

(22) Filed: Jan. 14, 2010

(65) Prior Publication Data

US 2010/0117560 A1 May 13, 2010

Related U.S. Application Data

(63) Continuation of application No. 11/538,357, filed on Oct. 3, 2006, now abandoned.

(51) Int. Cl.

| | |
|---|---|
| ***F21V 21/00*** | (2006.01) |
| ***F21V 23/00*** | (2015.01) |
| ***F21V 31/04*** | (2006.01) |
| ***G09F 9/33*** | (2006.01) |
| ***F21K 99/00*** | (2010.01) |
| *F21S 2/00* | (2006.01) |
| *F21Y 101/02* | (2006.01) |
| *F21Y 113/00* | (2006.01) |

(52) U.S. Cl.

CPC ..... *F21V 23/005* (2013.01); *F21K 9/30* (2013.01); *F21V 31/04* (2013.01); *G09F 9/33* (2013.01); *F21S 2/005* (2013.01); *F21Y 2101/02* (2013.01); *F21Y 2113/005* (2013.01)

(58) Field of Classification Search

CPC ..... F21K 9/30; F21S 2/005; F21V 23/005; F21W 2101/08; F21Y 2101/02; F21Y 2113/005; F21Y 2105/001; G02F 1/1336; G02F 2001/13342; G02F 1/133603; G09F 2013/222; H01L 25/0753; Y10S 362/80

USPC ..... 362/26, 27, 240–243, 245, 249.01, 362/249.02, 252, 290, 291, 304, 354, 361, 362/800, 802, 812, 249.06; 40/447, 450, 40/451, 452, 463, 541, 542, 550, 552, 553, 40/564, 567, 570, 573, 576, 579, 580, 40/591; 340/815.45, 815.53; 345/34, 82; 361/728

See application file for complete search history.

(56) References Cited

U.S. PATENT DOCUMENTS

| | | | | |
|---|---|---|---|---|
| 3,163,949 | A * | 1/1965 | Gley | 40/452 |
| 4,607,444 | A * | 8/1986 | Foster | 40/550 |
| 4,682,162 | A * | 7/1987 | Holloman | G09G 3/004 345/530 |
| 4,724,629 | A * | 2/1988 | Walton | 40/451 |

(Continued)

FOREIGN PATENT DOCUMENTS

KR 2006063179 A * 6/2006

*Primary Examiner* — Hargobind S Sawhney
(74) *Attorney, Agent, or Firm* — Ditthavong & Steiner, P.C.

(57) ABSTRACT

The present invention is an LED module for channel letter illumination utilizing multiple through-hole LEDs in a pixel formation as a light source where one surface mounted LED or other forms of LEDs were previously used. The use of a number of small through-hole LEDs ideally requires that a beam angle between and including 15° and 180° in vertical and horizontal directions, respectively, be utilized. When multiple light sources are used on a module, the distance between light sources is to be between 20 mm and 1 cm. The use of several smaller LEDs reduces the current needed to generate light of appropriate intensity and, thus reduces energy cost and heat generation. The use of smaller LEDs also assists in excess heat dissipation.

17 Claims, 3 Drawing Sheets

(56) References Cited

U.S. PATENT DOCUMENTS 4,967,317 A * 10/1990 Plumly ..... 362/613
5,020,253 A * 6/1991 Lie et al. ..... 40/576
5,268,828 A * 12/1993 Miura ..... 362/249.06
5,779,351 A * 7/1998 Erickson et al. ..... 362/241
5,808,592 A * 9/1998 Mizutani et al. ..... 345/83
5,841,357 A * 11/1998 Henry et al. ..... 340/636.13
6,058,634 A * 5/2000 McSpiritt ..... 40/452
6,169,632 B1 * 1/2001 Kurtenbach et al. ..... 359/621
6,328,454 B1 * 12/2001 Davis ..... 362/105
6,478,450 B1 * 11/2002 Grajcar ..... 362/239
6,536,913 B1 * 3/2003 Yajima et al. ..... 362/231
6,631,575 B1 * 10/2003 Voelzke et al. ..... 40/451
6,657,605 B1 * 12/2003 Boldt, Jr. ..... G02F 1/133504 345/83
6,817,123 B2 * 11/2004 Okazaki et al. ..... 40/452
6,829,852 B1 * 12/2004 Uehran ..... 40/451
6,857,767 B2 * 2/2005 Matsui et al. ..... 362/373
6,924,973 B2 * 8/2005 Kim ..... 361/728
7,071,620 B2 * 7/2006 Devos ..... F16B 5/0664 313/512
7,162,821 B2 1/2007 Venkataraman
7,241,031 B2 * 7/2007 Sloan et al. ..... 362/373
7,245,279 B2 * 7/2007 Wang ..... 345/84
7,255,460 B2 * 8/2007 Lee ..... 362/294
7,284,881 B2 * 10/2007 Kim et al. ..... 362/290
7,370,979 B2 * 5/2008 Whitehead ..... H04N 9/3102 345/207
7,556,403 B2 * 7/2009 Stadjuhar, Jr. ..... 362/290
7,918,591 B2 * 4/2011 Lynch ..... 362/365
8,111,208 B2 * 2/2012 Brown ..... 345/1.3
2002/0122134 A1 * 9/2002 Kalua ..... 348/383
2003/0031032 A1 * 2/2003 Wu et al. ..... 362/564
2003/0193816 A1 * 10/2003 Rahn ..... 362/555
2004/0070990 A1 * 4/2004 Szypszak ..... 362/555
2005/0062396 A1 * 3/2005 Yang ..... G09F 9/33 313/470
2005/0278998 A1 * 12/2005 Sawhney et al. ..... 40/541
2006/0098441 A1 * 5/2006 Chou ..... 362/294
2006/0215075 A1 * 9/2006 Huang ..... G02F 1/133603 349/67
2006/0227085 A1 * 10/2006 Boldt, Jr. ..... G09G 3/32 345/83

* cited by examiner

PIXILATED LED LIGHT SOURCE FOR CHANNEL LETTER ILLUMINATION

CROSS REFERENCES TO RELATED APPLICATIONS

Continuation of application Ser. No. 11/538,357, filed on Oct. 3, 2006, now abandoned.

FIELD OF THE INVENTION

The present invention relates to the field of channel letter illumination and more particularly relates to an efficient use of a customized through-hole LEDs to provide channel letter illumination.

BACKGROUND OF THE INVENTION

In recent years, LEDs have been used in commercial signage applications, particularly in channel letters in place of neon and other fluorescent lighting. One common construction of LED signage involves mounting at least one LED on a small module that can be attached in a string of such modules into channel letter forms. The string of modules is formed by each module and wires connecting them together, forming a relatively flexible lighted strand of LEDs for use in these applications. Each module must be constructed to withstand and disperse the heat generated by a single LED at it is powered to achieve useful intensity. Channel letter construction typically does not allow for efficient dispersion of heat as the letter forms are typically closed with tight interiors. Therefore, heat dispersion tends to be addressed in the construction of the LED modules by adding or making the modules themselves heat sinks. Heat sinks, however, collect heat and are typically a slow way to dissipate heat. Unfortunately, excess heat tends to lessen LED life and affect intensity, so added heat has a deleterious effect on LED signage.

The present invention is the use of a plurality of smaller, more efficient LEDs, in place of one LED on a module. The smaller LEDs are positioned in a formation called a pixel and the plurality of LEDs together generate the same light intensity with lower energy consumption and heat generation than a single large LED alone. The present invention represents a departure from the prior art in that the pixel formation of the present invention allows for use of smaller LEDs, with their efficiency benefits for lower energy costs, and lower construction cost as heat generation is less of a factor.

SUMMARY OF THE INVENTION

In view of the foregoing disadvantages inherent in the known types of LED lighting modules, this invention provides an improved LED lighting module that reduces both energy consumption and heat generation by using LEDs previously though too small for channel letter signage purposes.

To accomplish these objectives, the modules comprise an outer casing, ideally made of plastic, with an internal printed circuit board and driving circuit. Small, through-hole LEDs protrude through an upper surface of the module in a formation called a pixel, where the entire pixel is designed to replace a single LED as used in prior art applications. As such, the LEDs have a larger beam angle than prior art LEDs (which tend to be more focused) and the pixel shape in and of itself is chosen to maximize coverage. The modules according to the present invention generate significantly less heat than prior art modules, so a heat sink is unnecessary, leaving out a significant cost and weight to the modules.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. It is also to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the pixilated LED lighting module is herein described. It should be noted that the articles "a", "an" and "the", as used in this specification, include plural referents unless the content clearly dictates otherwise.

Figure 1:
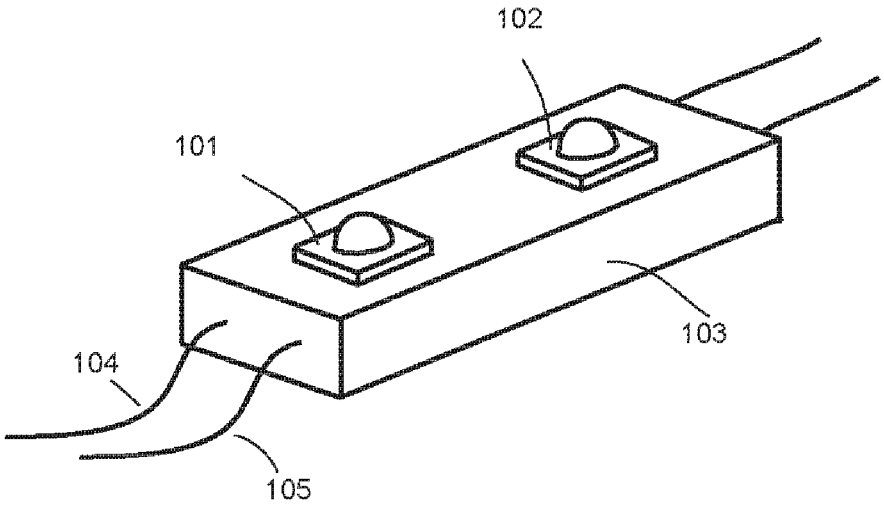
Fig. 1 (Prior Art)
FIG. 1 is a perspective view of a prior art LED module for channel letter illumination.

FIG. 1 depicts prior art, using piranha LEDs as light source for channel letter illumination. This format, using such large surface mounted LEDs 101, 102 as a light source, is widely used in the market. LEDs 101 and 102 in this example are piranha LEDs mounted on the upper surface of module 103. Most of the module 103 is metal to dissipate the heat generated by piranha LEDs 101 and 102. A plurality of modules 103 are electrically connected by wires 104, 105 and mounted in a channel letter for signage illumination. The disadvantage of this light source is that the both the intensity of emitted light and the covering angle are limited. Another issue is that a high input current has to be used with piranha LEDs in order to achieve high intensity, in turn generating more heat. Excess heat is detrimental for both LED intensity and lifetime so a metal base must be used to dissipate that heat. Since channel letter illumination uses a closed environment, heat dissipation is critical.

Figure 2:
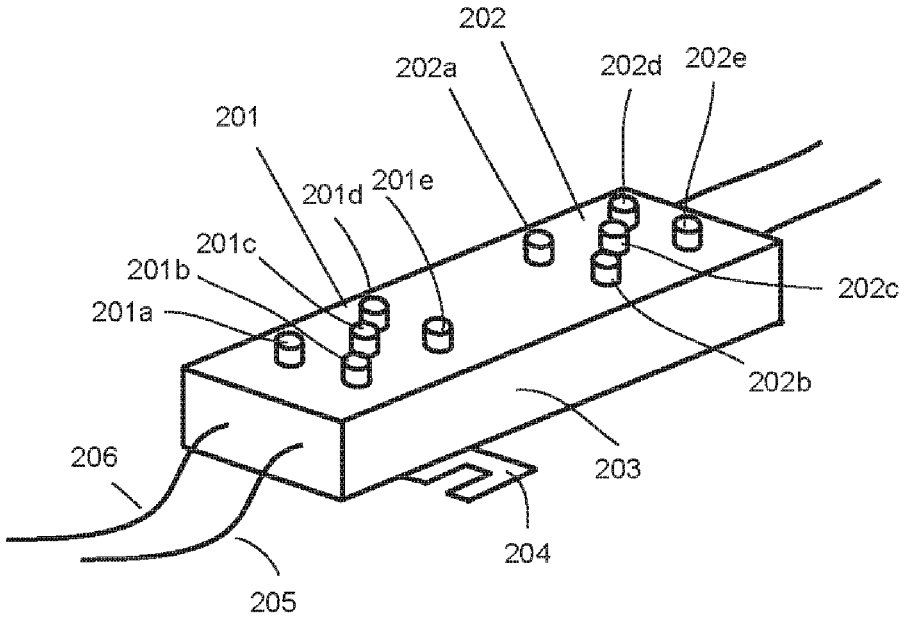
FIG. 2 is a perspective view of an LED module according to the present invention.

FIG. 2 depicts a module according to the present invention using LED pixels as light source for channel letter illumination. Ideally, the distance between pixels ranges from 20 mm to 1 cm. Pixel light sources 201 and 202 consist of a group of through-hole LEDs. The number of LEDs can be 3, 4, 5, more and etc. The figure illustrates two groups of 5 LEDs (201*a*-201*e* and 202*a*-202*e*) as pixel light sources where each LED is a through-hole LED. The LEDs can be 3 mm, or 5 mm oval or round through-hole type LEDs. Since both round and ovular shapes are elliptical, the term "elliptical" or "elliptically shaped" will be used in this application and the appended claims to include both round and ovular shapes. The LEDs may, of course, be of any color and combinations of colors in the pixel formation can yield colors that are not currently available in pure LED form. The most important parameters for the LEDs are LED beam angle and intensity. The intensity is dependent of applications. The preferred beam angle is larger than 15 degrees in each direction (horizontal and vertical) for either round or oval beams. The wide angle provides a more uniform light distribution than conventional surface mounted LEDs would. The preferred beam angle has an upper limit of 180 degrees. The arrangement of LEDs can be in any certain pattern, such as arcs, ellipses (including circles), stars, asterisks, triangles, squares, or rectangular patterns, to meet the light output requirements.

Plastic casing 203 encloses the light source 201, 202 and may or may not, depending on the desire of the user, be able to be reopened for maintenance. There is an attachment means, such as socket 204, on the casing 203. In the case of socket 204, a screw may be used to secure the module into the wall of channel letter. The socket 204 can be placed in any position on casing 203 for securing the casing to the wall of channel letter. There are connection wires 205 and 206 extending out of casing 203 for interconnection of pixel light modules. The module is sealed with glue or epoxy, particularly around the LEDs, for water or moisture proofing.

Figure 3:
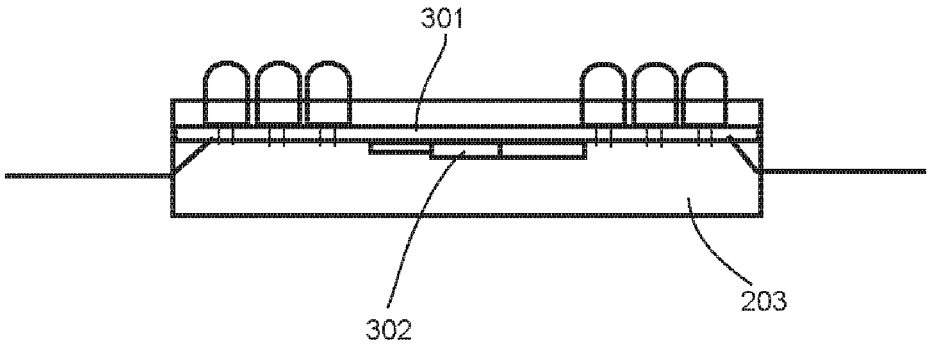
FIG. 3 is a cross-sectional view, taken lengthwise just right of the centerline, of the module of FIG. 2.

FIG. 3 depicts the cross section for a module with LED pixels as light source. Inside casing 203, there is a printed circuit board (PCB) 301 onto which through-hole LEDs are soldered. On the PCB board, there is an electronic circuit 302 to control the electrical current to each pixel. Preferably, the current to each LED is in constant current format. Since the through-hole LEDs require less current to drive and do not generate a large amount of heat, no heat sink in the form of metal casings and fillers are required. The circuit board can also be coated with epoxy or other conforming coating for water proofing purposes.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A light source module for providing light to a channel letter device, comprising:

a plastic casing, the plastic casing having a first surface and an attachment element configured for attaching the plastic casing to the channel letter device, wherein the first surface of the plastic casing has a length and a plurality of through-holes extending through the first surface, and the plurality of through-holes is arranged among a sequence of pixel groups;

wherein each one of the sequence of pixel groups has a cluster of through-holes confined to a corresponding one of a sequence of regions set apart a distance from one another along the length of the first surface, the number "M" of through-holes in each cluster is greater than or equal to 3 and wherein the number "N" of clusters of through-holes in the sequence of pixel groups is greater than or equal to 2;

a printed circuit board housed within the plastic casing; and a plurality of through-hole LEDs being electrically connected to the printed circuit board, the plurality of through-hole LEDs corresponding to, and extending through, the plurality of through-holes, a portion of each through-hole LED of the plurality of LEDs protruding from the plastic casing, each one of the plurality of through-hole LEDs having a diameter of about 5 mm or less.

2. The light source module of claim 1, further comprising a driving circuit connected to the printed circuit board to regulate the current and voltage to the plurality of LEDs.

3. The light source module of claim 2, wherein each one of the plurality of through-hole LEDs is elliptically shaped.

4. The light source module of claim 3, wherein each one of the plurality of through-hole LEDs has a diameter equal to about 5 mm.

5. The light source module of claim 4, wherein each one of the clusters of through-holes is arranged in a pattern duplicating a shape chosen from the set of shapes consisting of: stars, asterisks, triangles, squares, rectangles, ellipses and arcs.

6. The light source module of claim 5, wherein each one of the first plurality of through-hole LEDs has a color selected from the set of colors consisting of: red, green, blue, yellow, purple and white.

7. The light source module of claim 6, wherein the printed circuit board is coated with a waterproof epoxy coating and the light source module is sealed with waterproof epoxy coating.

8. The light source module of claim 1, wherein each one of the plurality of through-hole LEDs is elliptically shaped.

9. The light source module of claim 1, wherein each one of the plurality of through-hole LEDs has a diameter of about 5 mm.

10. The light source module of claim 1, wherein each one of the clusters of through-holes is arranged in a pattern duplicating a shape chosen from the set of shapes consisting of: stars, asterisks, triangles, squares, rectangles, ellipses and arcs.

11. The light source module of claim 1, wherein each one of the plurality of through-hole LEDs has a color selected from the set of colors consisting of: red, green, blue, yellow, purple and white.

12. The light source of claim 1, wherein the set-apart distance between each adjacent regions in the sequence of regions is between about 20 mm to about 1 cm.

13. The light source module of claim 1, wherein the printed circuit board is coated with a waterproof epoxy coating and the light source module is sealed with waterproof epoxy coating.

14. The light source module of claim 1, wherein the plurality of through-hole LEDs are not surface mounted LEDs.

15. The light source module of claim 1, wherein the light source module does not include a heat sink.

16. A light source module for providing light to a channel letter device, comprising:

a plastic casing, the plastic casing being enclosed and having a first surface;

an attachment socket for securing the light source module to a wall of the channel letter device, wherein the first surface of the plastic casing has a length and a plurality of through-holes extending through the first surface;

a printed circuit board housed within the plastic casing;

a plurality of through-hole LEDs being electrically connected to said printed circuit board, the plurality of through-hole LEDs corresponding to, and extending through, the plurality of through-holes in the first surface, a portion of each through-hole LED of the plurality of LEDs protruding from the plastic casing, each one of the plurality of through-hole LEDs having a diameter of about 5 mm or less;

an epoxy coating applied to the printed circuit board and around the first plurality of through-hole LEDs to seal the light source module; and a plurality of connection wires electrically connected to the printed circuit board and extending out of the plastic casing for supplying power to the light source module.

17. A light source module for providing light to a channel letter device, comprising:

a plastic casing, the plastic casing being enclosed and having a first surface;

an attachment socket connected to the plastic casing for securing the light source module to a wall of the channel letter device;

wherein the first surface of the plastic casing has a length and a plurality of through-holes extending through the first surface, the plurality of through-holes is arranged among a sequence of pixel groups;

wherein each one of the sequence of pixel groups has a cluster of through-holes confined to a corresponding one of a sequence of regions set apart a distance from one another along the length of the first surface, the number "M" of through-holes in each cluster is greater than or equal to 3 and the number "N" of clusters of through-holes in the sequence of pixel groups is greater than or equal to 2;

a printed circuit board housed within the plastic casing;

a plurality of through-hole LEDs being electrically connected to the printed circuit board, the plurality of through-hole LEDs corresponding to, and extending through, the plurality of through-holes in the first surface, a portion of each through-hole LED of the plurality of LEDs protruding from the plastic casing, each one of the plurality of through-hole LEDs having a diameter of about 5 mm or less;

an epoxy coating applied to the printed circuit board and around the plurality of through-hole LEDs to seal the light source module; and connection wires electrically connected to the printed circuit board and extending out of the casing for supplying power to the light source module;

wherein the plurality of through-hole LEDs is equal in number to M*N.

* * * * *